United States Patent [19]

Levy

[11] Patent Number: 5,008,984

[45] Date of Patent: Apr. 23, 1991

[54] MAGNETIC JEWELRY CLOSURE WITH CLIP

[76] Inventor: Davida Levy, 1340 Biscaya Dr., Surfside, Fla. 33154

[21] Appl. No.: 536,777

[22] Filed: Jun. 12, 1990

[51] Int. Cl.[5] ..... A44B 11/25

[52] U.S. Cl. ..... 24/303; 24/616

[58] Field of Search ..... 24/303, 616, 615, 618, 24/49 M, 94, 688; 292/251.5; 248/206.5

[56] References Cited

U.S. PATENT DOCUMENTS

| | | | |
|---|---|---|---|
| 1,807,293 | 5/1931 | Keller | 24/616 |
| 2,178,572 | 11/1939 | Forstner | 24/616 |
| 2,623,256 | 12/1952 | Feibelman | 24/303 |
| 2,648,884 | 8/1953 | Loofboro | 24/303 |
| 2,901,278 | 8/1959 | Robinson | 292/251.5 |
| 3,129,477 | 4/1964 | Mizuno | 24/303 |
| 4,426,854 | 1/1984 | Geldwerth et al. | 24/616 |
| 4,520,537 | 6/1985 | Valikov | 24/616 |
| 4,881,305 | 11/1989 | Rivera | 24/616 |

*Primary Examiner*—Victor N. Sakran

*Attorney, Agent, or Firm*—Berman, Aisenberg & Platt

[57] ABSTRACT

A jewelry closure includes a pair of closure members for magnetically engaging together. One or both closure members includes a magnet. A first closure member of the pair is supported by a casing which extends outwardly to receive the second closure member when both closure members are magnetically engaged together. The closure is secured by a clip attached to the outer surface of the casing. A portion of the clip lies adjacent an outer end surface of the second closure member when the closure is secured. In closed position the clip prevents the closure members from being separated when the jewelry closure is secured.

12 Claims, 1 Drawing Sheet

MAGNETIC JEWELRY CLOSURE WITH CLIP

FIELD OF THE INVENTION

The invention relates to magnetic jewelry closures.

BACKGROUND OF THE INVENTION

Known jewelry closures may be hard to close, particularly for elderly and/or disabled users. Magnetic jewelry closures, such as are described in my co-pending design patent application, application Ser. No 385,914, filed July 21, 1989, are very simple to use, but do not bear sufficient weight, unless a heavy duty magnet is used. Such a heavy duty magnet may be uncomfortable to wear and/or of unsuitable design for use with delicate jewelry. Another known magnetic closure is that shown in Mizuno, U.S. Pat. No. 3,129,477. Particularly when used for heavy or valuable jewelry, there may be a perceived lack of strength of these known magnetic closures due to the absence of a conventional closure.

SUMMARY OF THE INVENTION

A closure of the invention for jewelry, such as necklaces, bracelets and anklets, includes a pair of closure members for magnetically engaging together to join the ends of the jewelry. One or both closure members may include a magnet. A first closure member is supported in a casing which extends outwardly to receive the second closure member when both closure members are magnetically engaged together A clip is hinged at one end to an outside surface of the casing and, when the clip is closed, the other end lies substantially adjacent an outer surface of the second closure member. To secure the closure, in one embodiment, the clip is closed to engage a protrusion on the outer surface of the casing. Alternatively, in another embodiment, the clip is closed to engage a groove in the outer end surface of the second closure member. In both embodiments, the two parts of the jewelry cannot be separated before the clip is disengaged.

It is an object of the invention to provide a magnetic jewelry closure including a retaining clip which prevents separation of the closure members.

DETAILED DESCRIPTION OF THE INVENTION

The invention is a jewelry closure in which a pair of members which are joined to form the jewelry closure are attracted together by magnetic forces. The closure is firmly secured by a hinged clip which engages either a protrusion on the circumference of the closure or a groove on the end surface of the outer closure member to hold the closure firmly in place until the clip is opened. One or both members of the closure may include a magnet, and if only one member includes a magnet, the other member includes material, such as iron or steel, attracted to and held by the magnet of the first part.

A closure of the invention may be used to join any jewelry or clothing for which it is appropriate, and is particularly useful for closing necklaces, bracelets, anklets and belts. One member of the closure is carried by each end of the jewelry or clothing and the parts are joined by simply bringing the members together. The members join by magnetic attraction and the clip is closed to secure the closure.

Due to the magnetic attraction between the members of the closure, the members seek each other and even if the user is infirm or disabled, the jewelry may be closed effortlessly. After joining the closure members together, the clip is closed and the closure members cannot be separated until the clip is released.

Figure 1:
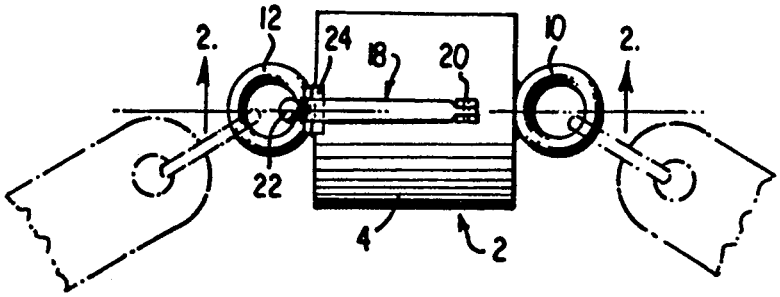
FIG. 1 is a side elevational view of a joined magnetic jewelry closure of the invention, showing the clip in closed position.
Figure 2:
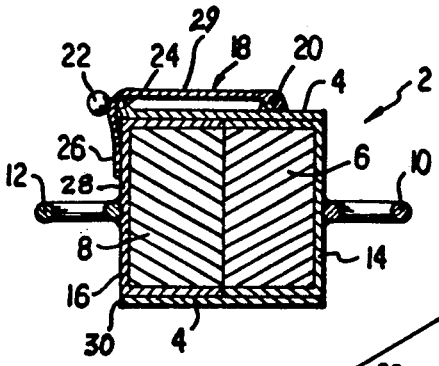
FIG. 2 is a cross sectional view taken on line 2—2 of FIG. 1.

With reference to FIGS. 1 to 7, in which like numerals represent like elements, cylindrical jewelry closure 2, shown secured in FIGS. 1 and 2, includes a cylindrical casing 4 which encloses first closure member 6 and second closure member 8 of jewelry closure 2. First closure member 6 is attached to casing 4 and second closure member 8 is magnetically held in casing 4 when the jewelry closure is secured. Members 6 and 8 may both include magnets. Any type of magnet may be used. If only one member includes a magnet, either member 6 or member 8 may include the magnet. Preferably first member 6 includes the magnet, and second member 8 includes the magnetically attracted material.

Attachments for jewelry, such as jewelry attaching rings 10 and 12, are secured to first member 6 and second member 8 respectively, and jewelry (shown in phantom in FIG. 1) is attached thereto. As seen in FIG. 2, first member 6 and second member 8 are surrounded by individual casings 14 and 16, respectively, to which rings 10 and 12 are attached. Casing 14 for first member 6 is secured to outer cylindrical casing 4, by adhesive, welding or other known methods. Cylindrical casing 4 may optionally include an end wall, such as end wall 45 of casing 44, shown in FIG. 6, and, if an end wall is used, ring 10 would be attached to that end wall.

FIGS. 1 to 4 illustrate clip 18 attached by hinge 20 to an outer surface of casing 4. Clip 18 is opened by moving bead 22, located at the forward end of the clip, upwardly. Clip 18 is shown in open position in FIG. 3. In closed position, shown in FIGS. 1, 2 and 4, clip 18 is held in an interference fit with protrusion 24 on the edge of casing 4. When clip 18 is in closed position, tip 26 of clip 18 extends downwardly from bead 22 substantially adjacent end surface 28 of casing 16 for second member 8. Tip 26 may be an elongated extension of clip 18 substantially at right angles to elongated portion 29 of clip 18, or tip 26 may be a flattened portion of any configuration which lies adjacent end surface 28, substantially parallel to and covering a portion of end surface 28. Tip 26 either may rest against surface 28, when closure members 6 and 8 are magnetically joined together, or may be spaced from surface 28.

It is critical that tip 26 is sized so that outward force tending to separate closure members 6 and 8 fails to separate the members until clip 18 is released from its interference fit with protrusion 24. Closure member 8 cannot be withdrawn from casing 4 until clip 8 is released from engagement with protrusion 24.

Figure 3:
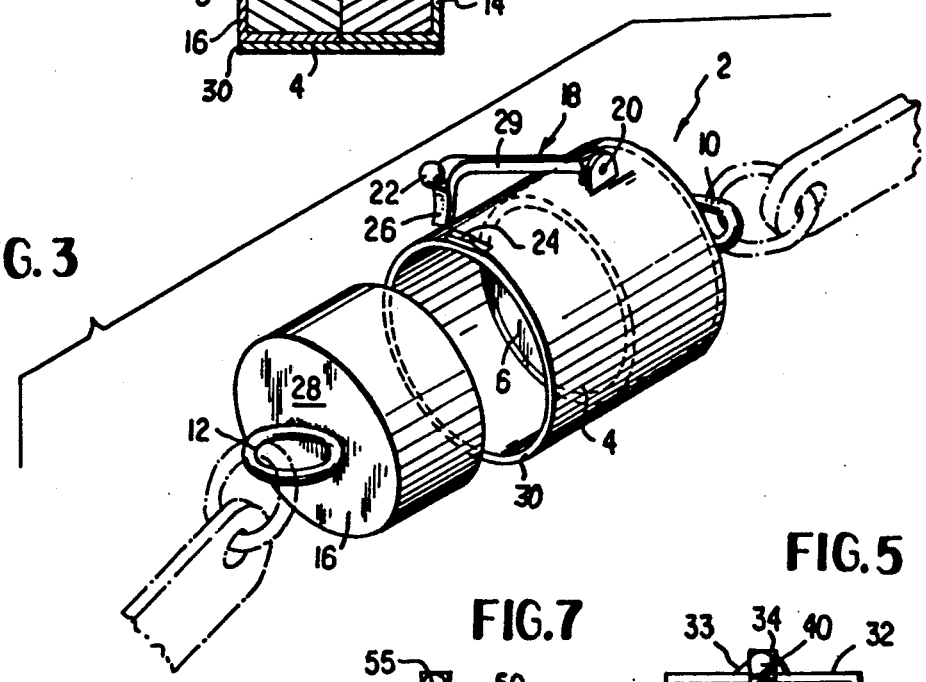
FIG. 3 is a perspective view of a closure of FIG. 1, in position for joining.
Figure 5:
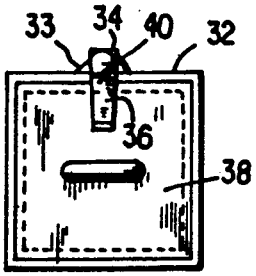
FIG. 5 is an end view of an alternative embodiment of the closure, showing the clip in closed position.

FIG. 3 shows a cylindrical magnetic jewelry closure of the invention, in use. When the parts are separated, first closure member 6 is held in one hand and second member 8 is held in the other hand. Member 6 is surrounded by cylindrical casing 4. To close jewelry, such as a necklace, member 8 is inserted into cylindrical casing 4, adjacent first member 6, and is held magnetically thereby. Casing edge 30, seen in FIGS. 2 to 4, may be co-extensive with end surface 28 of second member 8, or may protrude slightly beyond end surface 28 when members 6 and 8 are joined. In the latter case, tip 26 may be spaced from end surface 28 when clip 18 is in closed position.

Figure 4:
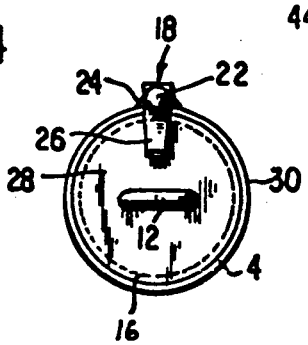
FIG. 4 is an end view of a joined closure, showing the clip in closed position.

On closing clip 18, the clip engages protrusion 24, which may be a bead, as shown in FIGS. 2 and 3, and tip 26 of clip 18 either touches end face 28 or is spaced therefrom. Outward force, tending to separate closure members 6 and 8, will not separate the two members, since clip 18 holds the two members together until bead 22 on clip 18 is lifted, releasing clip 18 from engagement with protrusion 24. FIGS. 2 and 4 show clip 18 in closed position adjacent end face 28.

Cylindrical casing 4 allows second closure member 8 to be inserted into cylindrical casing 4 at any angle of rotation, before the clip is closed, provided that first and second members 6 and 8 engage together magnetically. Protrusion 24, engaged by clip 18 when the clip is closed, is located on the edge of casing 4, in the same plane as clip 18. Protrusion 24 may be a bead, as shown, or may be a lip around at least a portion of edge 30 of casing 4. It is critical that clip 18 be firmly engaged by protrusion 24 so that the clip is only released when bead 22 is lifted. Clip 18 is secured by engagement with protrusion 24 on cylindrical casing 4, without reference to second closure member 8. Thus the jewelry closure is extremely easy to use.

The jewelry closure is not limited to having a circular cross-section. Any appropriate shape may be used. In a non-limiting alternative embodiment, shown in FIG. 5, outer casing 32 is square in cross-section. Square closures, at least one of which contains a magnet, are attached to jewelry and inserted in outer casing 32, which is square in cross-section. Clip 34 is engaged on outer casing 32, similarly to the engagement of clip 18 on cylindrical casing 4. Tip 36 holds end member 38 in closed position in square cross-section casing 32, similarly to the way in which closure member 8 is held in position in cylindrical casing 4 against outward pulling force by tip 26 of clip 18. Protrusion 33 on casing 32 holds clip 34 in position. Clip 34 is opened by lifting bead 40.

Figure 7:
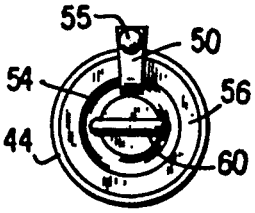
FIG. 7 is an end view of the embodiment of FIG. 6.
Figure 6:
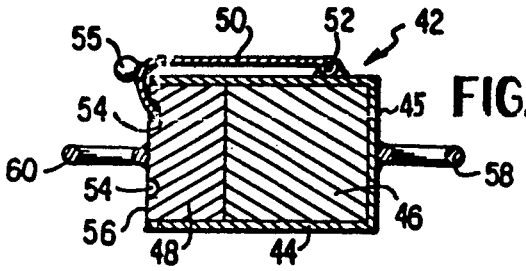
FIG. 6 is a cross-sectional view, similar to FIG. 2, of another embodiment of the invention.

In an alternative embodiment, shown in FIGS. 6 and 7, jewelry closure 42 is shown in cross-section in FIG. 6. Cylindrical casing 44 including end wall 45 holds magnetic member 46 which is adhesively secured in casing 44 (without a separate magnet casing). Member 48 may or may not be a magnetic member, but is attracted by magnetic member 46 when brought up to the open end of casing 44 to fasten the jewelry closure. As seen, members 46 and 48 need not have individual casings, although casings, such as casings 14 and 16, shown in FIG. 2, may be used.

Member 48 is inserted into cylindrical casing 44 and clip 50, which is pivoted at hinge 52 is closed to a position adjacent groove 54 in end surface 56 of closure member 48. Groove 54 may be an annular groove inside the perimeter of end surface 56, enabling closure member 48 to be inserted in cylindrical casing 44 at any convenient orientation. Alternatives to groove 54 will be apparent to those skilled in the art. Jewelry is attached to rings 58 and 60. Clip 50 is opened by lifting knob 55, thereby enabling members 46 and 48 to be separated.

As seen in FIG. 6, closure member 44 is larger than closure member 48. It is generally preferred, if only one member is magnetic, that the magnetic member be the member fixed in the casing. The other member, which need not be a magnet, may be the same size as or a different size from the fixed member as long as there is sufficient magnetic attraction for the parts to be securely attracted and held together for easy closure. Any type of magnet may be used.

Cylindrical casing 4 or 44, or square casing 32, or an outer casing of other appropriate shape, may be plain or ornamented, and may be of material, such as metal or rigid plastic, or color selected to match or tone with the jewelry being joined. The outer casings may also be decorated attractively.

A jewelry closure of the invention may be any size and shape as long as the faces of the first and second closure members are joined magnetically and fasten securely together to hold the jewelry in closed position. A clip on the jewelry closure may be attached to any shape of outer casing and may be adapted to hold the second closure member in the casing in any way within the scope of the invention which prevents the members from being separated when the clip is released. The clip preferably closes with a "click" so that the user is confident that the closure is secure.

Other shapes for the jewelry closure will be apparent to one skilled in the art. The shape of the closure is not limited by the examples illustrated herein.

Closures of the invention may be used to join two chains or other jewelry, as illustrated in co-pending design patent application, application Ser. No. 385,914, the specification of which is incorporated herein, by reference.

The closures described may be used with any type of jewelry, such as chains, strings of beads, or other jewelry. Various pieces of jewelry may be joined together, firmly and with great versatility, using these closures. These closures may also be used for clothing or belts or other accessories.

While the invention has been described with respect to certain embodiments thereof, variations and modifications may be made without departing from the spirit and scope of the invention.

What is claimed is:

1. A jewelry closure comprising:

first and second closure members for engaging together wherein at least one of said closure members comprises a magnet;

casing means for supporting said first closure member and extending outwardly for supporting said second closure member; and means located on said casing means for engaging adjacent an outer end surface of said second closure member when said second closure member is held by magnetic attraction to said first closure member, said engaging means comprising an elongated member having a first end hinged to said casing means and a second end which lies adjacent said outer end surface of said second closure member when said jewelry closure is in secured position, wherein said hinged means is engaged with a protrusion on said casing means when said jewelry closure is in secured position;

whereby said closure members cannot be separated from magnetic engagement with each other until after said engaging means is released from its position adjacent said second closure member.

2. A jewelry closure comprising:

first and second closure members for engaging together wherein at least one of said members comprises a magnet and the other of said members comprises magnetically attracted material;

casing means for supporting said first closure member, attached to said first closure member and extending outwardly for receiving said second closure member; and clip means comprising a first end hinged to said casing means and a second end adapted to lie substantially parallel to an outer end surface of said second member when said first and second closure members are magnetically engaged together;

means protruding from said casing means for engaging said clip means, wherein said protruding means extends from an outer edge of said casing means, whereby said second closure member cannot be withdrawn from said casing means when said closure members are magnetically engaged together and said clip means is engaged with said protruding means.

3. A jewelry closure of claim 2 wherein said first and second closure members are of cylindrical shape and said casings means is of cylindrical shape.

4. A jewelry closure of claim 2 wherein said casings means and said clip means each comprise metal.

5. A jewelry closure of claim 2 wherein said first member comprises a magnet and said second member comprises magnetically attracted material.

6. A jewelry closure of claim 5 wherein both said members comprise magnets.

7. A jewelry closure comprising:

first and second closure members for engaging together wherein at least one of said members comprises a magnet and the other of said members comprises magnetically attracted material;

casing means for supporting said first closure member, attached to said first closure member and extending outwardly for receiving said second closure member; and clip means comprising a first end hinged to said casing means and a second end adapted to lie substantially adjacent an outer end surface of said second closure member when said jewelry closure is in secured position;

means on said outer surface of said second closure member for retaining said clip means, wherein said retaining means comprises an annular groove in said outer end surface of said second closure member, whereby said second closure member cannot be withdrawn from said casing means when said closure members are magnetically engaged together and said clip means is engaged with said retaining means.

8. A jewelry closure according to claim 7 wherein said hinged means is engaged with said groove in said outer end surface of said second closure member when said jewelry closure is in secured position.

9. A jewelry closure of claim 7 wherein said first and second closure members are of cylindrical shape and said supporting means is of cylindrical shape.

10. A jewelry closure of claim 7 wherein said supporting means and said clip means each comprise metal.

11. A jewelry closure of claim 7 wherein said first member comprises a magnet and said second member comprises magnetically attracted material.

12. A jewelry closure of claim 11 wherein both said members comprise magnets.

* * * * *